US007104265B2

(12) United States Patent
Von Borstel

(10) Patent No.: US 7,104,265 B2
(45) Date of Patent: Sep. 12, 2006

(54) FILTER CONTAINING A METAL PHTHALOCYANINE AND A POLYCATIONIC POLYMER

(75) Inventor: Reid Von Borstel, Potomac, MD (US)

(73) Assignee: Filligent Limited, Hong Kong (CN)

( * ) Notice: Subject to any disclaimer, the term of this patent is extended or adjusted under 35 U.S.C. 154(b) by 0 days.

(21) Appl. No.: 10/803,409

(22) Filed: Mar. 17, 2004

(65) Prior Publication Data

US 2004/0173227 A1 Sep. 9, 2004

Related U.S. Application Data

(63) Continuation of application No. PCT/US04/04884, filed on Feb. 18, 2004.

(60) Provisional application No. 60/448,719, filed on Feb. 18, 2003.

(51) Int. Cl.
*A24D 3/14* (2006.01)

(52) U.S. Cl. ..... 131/334; 131/332; 131/331; 131/200

(58) Field of Classification Search ..... 131/341, 131/344, 200, 88, 94, 328, 334, 331, 335, 131/332; 493/39, 50
See application file for complete search history.

(56) References Cited

U.S. PATENT DOCUMENTS

| | | | | |
|---|---|---|---|---|
| 2,721,140 | A | 10/1955 | Weisgerber | 92/3 |
| 2,882,120 | A | 4/1959 | Stoddard et al. | 8/105 |
| 3,279,476 | A | 10/1966 | Noznick et al. | 131/10.7 |
| 3,313,305 | A | 4/1967 | Noznick et al. | 131/10.7 |
| 3,340,879 | A | 9/1967 | Horsewell et al. | 131/267 |
| 3,658,070 | A | 4/1972 | Diluzio | 131/267 |
| 3,674,540 | A | 7/1972 | Pergaminos | 117/56 |
| 3,884,246 | A | 5/1975 | Walker | 131/10.1 |
| 3,886,955 | A | 6/1975 | Johnson et al. | 131/261 R |
| 3,982,897 | A | 9/1976 | Scheinberg | 23/232 R |
| 4,037,607 | A | 7/1977 | Grossman | 131/10 R |
| 4,076,031 | A | 2/1978 | Grossman | 131/261 A |
| 4,092,333 | A | 5/1978 | Mookherjee et al. | 260/347.2 |
| 4,096,158 | A | 6/1978 | Evers et al. | 260/347.2 |
| 4,126,708 | A | 11/1978 | Mookherjee et al. | 426/535 |
| 4,138,413 | A | 2/1979 | Mookherjee et al. | 260/347.2 |
| 4,156,431 | A | 5/1979 | Epstein et al. | 131/10.7 |
| 4,194,517 | A | 3/1980 | Borowski | 131/261 R |
| 4,248,251 | A | 2/1981 | Bryant, Jr. et al. | 131/140 B |
| 4,257,430 | A | 3/1981 | Collins et al. | 131/140 B |
| 4,258,730 | A | 3/1981 | Tsukamoto | 131/170 R |
| 4,260,523 | A | 4/1981 | Tsukamoto | 252/447 |
| 4,333,484 | A | 6/1982 | Keritsis | 131/359 |
| 4,414,988 | A | 11/1983 | Yagi | 131/334 |
| 4,438,775 | A | 3/1984 | Mays et al. | 131/300 |
| 4,489,739 | A | 12/1984 | Mattina, Jr. et al. | 131/352 |
| 4,506,684 | A | 3/1985 | Keritsis | 131/369 |
| 4,508,525 | A | 4/1985 | Berger | 493/43 |
| 4,532,947 | A | 8/1985 | Caseley | 131/331 |
| 4,537,204 | A | 8/1985 | Gaisch et al. | 131/274 |
| 4,612,942 | A | 9/1986 | Dobberstein et al. | 131/276 |
| 4,761,277 | A | 8/1988 | Valdes et al. | 424/64 |
| 4,763,674 | A | 8/1988 | Lelah | 131/342 |
| 4,896,683 | A | 1/1990 | Cohen et al. | 131/342 |
| 4,946,968 | A | 8/1990 | Krimmer et al. | 548/534 |
| 4,964,426 | A | 10/1990 | Lee et al. | 131/342 |
| 5,009,239 | A | 4/1991 | Cohen et al. | 131/342 |
| 5,058,607 | A | 10/1991 | Carter et al. | 131/58 |
| 5,060,672 | A | 10/1991 | Irimi et al. | 131/331 |
| 5,218,096 | A | 6/1993 | Shibuya et al. | 536/41 |
| 5,249,588 | A | 10/1993 | Brown et al. | 131/291 |
| 5,501,238 | A | 3/1996 | Von Borstel et al. | 131/331 |
| 5,909,736 | A | 6/1999 | Stavridis et al. | 131/331 |
| 5,975,086 | A * | 11/1999 | Lesser et al. | 131/331 |
| 6,792,953 | B1 * | 9/2004 | Lesser et al. | 131/334 |

FOREIGN PATENT DOCUMENTS

| | | |
|---|---|---|
| DE | 27 02 234 | 7/1978 |
| EP | 0121436 A2 | 10/1984 |
| EP | 0402060 | 12/1990 |
| FR | A2 149 674 | 3/1973 |
| GB | 1 305 369 | 1/1973 |
| GB | 1 435 504 | 5/1976 |
| JP | 57-138375 | 8/1982 |
| SU | 1163832 A | 6/1985 |

OTHER PUBLICATIONS

Hayatsu, Hikoya et al., "Porphyrins as potential inhibitors against exposure to carcinogens and mutagens," *Mutation Research* 290:79–85 (1993).

* cited by examiner

*Primary Examiner*—Dionne A. Walls
(74) *Attorney, Agent, or Firm*—David A. Farah; Sheldon & Mak PC

(57) ABSTRACT

A tobacco smoke filter comprising one or more than one metal phthalocyanine, such as a copper phthalocyanine or an iron phthalocyanine, and further comprising one or more than one polycationic polymer.

145 Claims, No Drawings

FILTER CONTAINING A METAL PHTHALOCYANINE AND A POLYCATIONIC POLYMER

CROSS-REFERENCE TO RELATED APPLICATIONS

The present Application is a continuation of PCT Patent Application PCT/US04/04884 titled "Filter Containing a Metal Phthalocyanine and a Polycationic Polymer," and filed on Feb. 18, 2004; that claims the benefit U.S. patent application Ser. No. 60/448,719 titled "Filter Containing a Metal Phthalocyanine and PEI," and filed Feb. 18, 2003; the contents of which are incorporated in this disclosure by reference in their entirety.

BACKGROUND

It is widely known that tobacco smoke contains mutagenic and carcinogenic compounds which cause substantial morbidity and mortality to smokers. Examples of such substances include polycyclic aromatic hydrocarbons (PAH) and nitrosamines.

Polycyclic aromatic hydrocarbons appear to cause toxicity by intercalating within DNA molecules. Nitrosamines are electrophilic, alkylating agents which are potent carcinogens. Nitrosamines are not present in fresh or green tobaccos and are not formed during combustion. They are instead formed by reactions involving free nitrate during processing and storage of tobacco, or by the post-inhalation, metabolic activation of secondary amines present in tobacco smoke.

Attempts to reduce the amount of toxic and mutagenic compounds that reach the smoker include tobacco smoke filters positioned between the burning tobacco and the smoker. Conventional filters are made of cellulose acetate, with or without activated charcoal. These conventional filters, however, are only partially effective in reducing the amount of toxic and mutagenic compounds reaching the smoker. Further, conventional filters disadvantageously remove flavor compounds, thereby decreasing acceptance by the smoker.

Additionally, tobacco smokers tend to titrate their dose of nicotine to obtain the same amount of nicotine from low nicotine content tobacco products by inhaling more smoke than they would when using a high nicotine content a tobacco product. Hence, tobacco smokers will potentially be exposed to a greater amount of some carcinogens when using low nicotine content tobacco products than when using high nicotine content tobacco products.

There is, therefore, a need for an improved filter for a smokable device that substantially removes toxic and mutagenic compounds from tobacco smoke. Further, there is a need for an improved filter which allows the passage of flavor compounds while substantially removing toxic and mutagenic compounds from tobacco smoke. Additionally, there is a need for an improved filter which increases the ratio of nicotine to mutagenic compounds. Such an improved filter would preferably be simple and inexpensive to manufacture, and convenient to use.

SUMMARY

According to one embodiment of the present invention, there is provided a tobacco smoke filter comprising one or more than one metal phthalocyanine, and further comprising one or more than one polycationic polymer. In one embodiment, the one or more than one metal phthalocyanine is a copper phthalocyanine. In a preferred embodiment, the copper phthalocyanine is selected from the group consisting of C.I. Reactive Blue 21 dye and ORCO Turquoise Blue GGX dye. In a preferred embodiment, the one or more than one metal phthalocyanine is an iron phthalocyanine, such as an iron analog of C.I. Reactive Blue 21 dye.

In another embodiment, the one or more than one polycationic polymer has a cationic moiety comprising one or more than one primary or secondary amino group. In a preferred embodiment, the one or more than one polycationic polymer is selected from the group consisting of poly(propyleneimine), polyvinylamine, poly(2-ethylaziridine), poly(2,2-dimethylaziridine, and poly(2,2-dimethyl-3-n-propylaziridine) and a combination of the preceding. In a particularly preferred embodiment, the one or more than one polycationic polymer is polyethyleneimine (PEI).

In a preferred embodiment, the one or more than one polycationic polymer has a molecular weight greater than about 1000 Daltons. In another preferred embodiment, the one or more than one polycationic polymer has a molecular weight of between about 1000 and 100,000 Daltons. In a preferred embodiment, the filter further comprises cellulose that is substantially free of cellulose acetate.

In a preferred embodiment, the one or more than one metal phthalocyanine is a copper phthalocyanine, and the polycationic polymer is polyethyleneimine. In another preferred embodiment, the one or more than one metal phthalocyanine is an iron phthalocyanine, and where the polycationic polymer is polyethyleneimine.

In one embodiment, the tobacco smoke filter of the present invention additionally comprises one or more than one pH-modifying filter additive, other than the polycationic polymer. In another embodiment, the one or more than one pH-modifying filter additive is an inorganic salt, such as sodium carbonate, calcium carbonate, sodium phosphate, calcium phosphate or a cationic ion exchange resin. In another embodiment, the tobacco smoke filter further comprises chitin.

In one embodiment, the one or more than one metal phthalocyanine and the one or more than one polycationic polymer are dispersed throughout the filter in a substantially uniform manner. In another embodiment, the tobacco smoke filter comprises a first segment and a second segment, the first segment comprises the one or more than one metal phthalocyanine and the one or more than one polycationic polymer, and the second segment is substantially free of both a metal phthalocyanine and a polycationic polymer. In another embodiment, the tobacco smoke filter comprises a first segment, a second segment and a third segment, and the first segment comprises the one or more than one metal phthalocyanine but is substantially free of a polycationic polymer, the second segment comprises both the one or more than one metal phthalocyanine and the one or more than one polycationic polymer, and the third segment comprises one or more than one polycationic polymer but is substantially free of a metal phthalocyanine.

According to another embodiment of the present invention, there is provided a smokable device comprising a tobacco smoke filter according to the present invention.

According to another embodiment of the present invention, there is provided a method of filtering tobacco smoke comprising, first, providing a smokable device according to the present invention, igniting the body of divided tobacco such that smoke passes through the body and into the filter, and allowing the smoke to pass through the filter, thereby filtering the smoke.

According to another embodiment of the present invention, there is provided a method of making a smokable device comprising, first, providing a tobacco smoke filter according the present invention, and affixing the filter to a body of divided tobacco. In one embodiment, the method further comprises spraying a solution of the one or more than one polycationic polymer onto material being made into the tobacco smoke filter, where the concentration of polycationic polymer in the solution is between about 0.5 and 50%. In another embodiment, the method further comprises spraying a solution of the one or more than one polycationic polymer onto material being made into the tobacco smoke filter, where the concentration of polycationic polymer in the solution is between about 1 and 10%. In another embodiment, the tobacco smoke filter comprises paper made from pulp, and the method further comprises adding the polycationic polymer to the pulp before the pulp is laid onto papermaking screens.

DESCRIPTION

According to one embodiment of the present invention, there is provided a filter for tobacco smoke. The filter can be provided in combination with cigarettes or cigars or other smokable devices containing divided tobacco, Preferably, the filter is secured to one end of the smokable device, positioned such that smoke produced from the tobacco passes into the filter before entering the smoker. The filter can also be provided by itself, in a form suitable for attachment to a cigarette, cigar, pipe, or other smokable device.

The filter according to the present invention advantageously removes a significant proportion of mutagens and carcinogens from cigarette smoke. The filter further retains satisfactory or improved smoke flavor, nicotine content, and draw characteristics. The filter is designed to be acceptable to the user, being neither cumbersome nor unattractive as are commercially made filters which are designed to add onto the ends of premade cigarettes. Further, filters according to the present invention can be made of inexpensive, safe and effective components, and can be manufactured with only minor modifications of standard cigarette manufacturing machinery.

According to one embodiment of the present invention, the filter comprises a porous substrate. The porous substrate can be any nontoxic material suitable for use in filters for smokable devices that are also suitable for incorporation with the other substances according to embodiments of the present invention. Such porous substrates include cellulosic fiber such as cellulose acetate, cotton, wood pulp, and paper; and polyesters, polyolefins, ion exchange materials and other materials as will be understood by those with skill in the art with reference to this disclosure.

As used herein, the term "comprise" and variations of the term, such as "comprising" and "comprises," are not intended to exclude other additives, components, integers or steps.

Filter Containing a Humectant

According to one embodiment of the present invention, the filter comprises one or more than one humectant, with or without other substances disclosed herein. The humectant is capable of absorbing moisture from tobacco smoke and releasing it into the porous substrate in order to wet-filter tobacco smoke that passes through the filter. Among other advantages, wet-filtration systems according to the present invention help remove particulate matter from tobacco smoke and can be made integral with a tobacco containing product.

The humectant can be any suitable humectant. For example, the humectant can be selected from the group consisting of glycerol, sorbitol, propylene glycol, sodium lactate, calcium chloride, potassium phosphate, sodium pyrophosphate or sodium polyphosphate, calcium citrate, calcium gluconate, potassium citrate, potassium gluconate, sodium tartrate, sodium potassium tartrate, and sodium glutamate.

In a preferred embodiment, the humectant incorporated into the filter is sodium pyroglutamate (also known as sodium 2-pyrrolidone-5-carboxylate or NaPCA). Advantageously, sodium pyroglutamate is nontoxic, effective at removing charged particles from tobacco smoke and functions as a humectant in the temperature range of tobacco smoke. Further, it is nonhazardous, stable, simple to manufacture and convenient to use. Sodium pyroglutamate has the following structure:

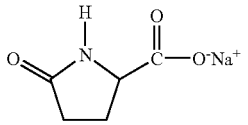

Filters according to the present invention are simple and inexpensive to manufacture. In one method of manufacture, a solution containing the humectant, such as sodium pyroglutamate, is prepared. Then, the porous substrate is wetted with the solution. The wetted substrate is then dried, leaving a residue of the humectant dispersed on or in the porous substrate. In a preferred embodiment, the humectant is present in an amount of from about 5 to about 60% by dry weight of the filter.

The effectiveness of a tobacco smoke filter containing sodium pyroglutamate according to the present invention was tested as follows.

Three types of filters were tested for relative effectiveness in removing tar from cigarette smoke:

1) Conventional cellulose acetate filter ("Cell-Ac");

2) Wet-filtration tobacco smoke filter containing cellulose acetate with sodium pyroglutamate ("SoPyro") according to the present invention; and 3) Commercially available wet-filtration tobacco smoke filter (Aquafilter®, Aquafilter Corp.).

Cellulose acetate filters containing sodium pyroglutamate were prepared by, first, removing cellulosic filters from commercial cigarettes. The fibers weighed approximately 0.21 g. Next, approximately 0.5 ml of a 10% by weight solution of sodium pyroglutamate was applied to each filter, and the filter was dried overnight at 60° C.

The conventional cellulose acetate filter and the cellulose acetate filters containing sodium pyroglutamate were weighed and inserted into a 40 mm segment of polycarbonate tubing having an inside diameter identical to the outside diameter of a standard cigarette. A filterless cigarette having 0.85 g of tobacco was inserted into one end of the polycarbonate tubing in proximity to one end of the filter. The other end of the polycarbonate tubing was attached to tubing connected to a suction pump. Duplicates of each filter type were tested. Each Aquafilter® used in this test was also attached to a filterless cigarette having 0.85 g of tobacco and then attached to tubing connected to a suction pump.

The filtered cigarettes were lit and intermittent suction, simulating inhalation of cigarette smoke, was applied until the cigarette had burned to within 12.5 mm of the unlit end. The filters were removed from either the polycarbonate tube or were removed from the Aquafilter®, weighed, and placed in 10 ml of methanol to elute tar and other substances from the smoke that were retained in the filter. Light absorbance (at a wavelength of 350 nm) of the ethanolic filter eluates was used as an index of the amount of smoke components retained on the filters. The weight gained by the filters during smoke passage was also recorded. The results of the test are presented in Table 1.

TABLE 1

| TEST | FILTER | ABSORBANCE at 350 nm | Weight Gain |
|---|---|---|---|
| 1 | Cell-Ac | 0.470 A.U. | 35 mg |
| 2 | Cell-Ac | 0.381 A.U. | 30 mg |
| 3 | SoPyro | 0.731 A.U. | 71 mg |
| 4 | SoPyro | 0.625 A.U. | 60 mg |
| 5 | Aquafilter ® | 0.540 A.U. | * |
| 6 | Aquafilter ® | 0.560 A.U. | * |

*The weight gain due to absorbance of smoke components on the Aquafilter ® could not be determined, since the Aquafilter ® actually lost weight during passage of smoke, presumably due to evaporation of water.

Based on the absorbance data, the filters according to one embodiment of the present invention (Tests 3 and 4) are significantly more effective than conventional cellulose acetate filters without the humectant (Tests 1 and 2), and also more effective than the Aquafilter® (Tests 5 and 6).

Filter Containing Dry Water

According to another embodiment of the present invention, there is provided a filter for wet-filtering tobacco smoke comprising "dry water," with or without other substances disclosed herein. Dry water is a combination of methylated silica and water. In one embodiment, the methylated silica is present in an amount from about 5 to 40% and the water is present in an amount from about 60 to 95% by weight. In a preferred embodiment, the methylated silica is present in an amount of about 10% and the water is present in an amount of about 90% by weight. Advantageously, dry water has good stability when used in a filter according to the present invention. Further, it is inexpensive, nontoxic and not harmful to the environment.

In a preferred embodiment, dry water is present in an amount of about 1% to about 20% by weight of the filter. In a particularly preferred embodiment, dry water is present in an amount of about 5% to about 10% by weight of the filter.

Dry water for use with the present invention can be made, for example, by shaking excess water with methylated silica in a closed container until an equilibrium emulsion is achieved. Excess water is decanted, and a drying agent, such as non-derivatized silica, is added in amounts equivalent to 10% of the amount of methylated silica in the emulsion. The emulsion is further shaken to disperse the drying agent.

One problem associated with the use of dry water in a tobacco smoke filter is that, when present as a continuous layer between the tobacco and the smoker, dry water tends to clog pores in the filter, thereby increasing resistance to airflow and decreasing smoking pleasure. In order to overcome this problem, there is provided an embodiment of the present invention having dry water admixed with a loose fibrous material. This additional fibrous material provides scaffolding to reduce impaction of silica particles into the filter material when suction is applied by the smoker. Examples of such material include cellulose or cellulose acetate having fiber lengths short enough such that the dry water behaves as a flowable powder. In a preferred embodiment, the fiber length is less than about 1 mm. In a preferred embodiment, the tobacco smoke filter according to the present invention includes both a porphyrin, as discussed herein, in addition to the dry water. For example, a tobacco smoke filter according to the present invention includes a section of between about 3 mm and 6 mm filled with dry water, chlorophyllin and cellulose, within the filter or at the distal end of the filter between the conventional filter material and the tobacco. Tobacco smoke in such a filter passes through the dry water and porphyrin which retain carcinogenic smoke constituents within the dry water and chlorophyllin layer.

Tobacco smoke filters according to this aspect of the present invention can be made by adding a dry water and porphyrin mixture during manufacture of the filter or can be made by injecting the mixture into the filter or at the interface between the tobacco and the conventional filter. The dry water and porphyrin mixture can be injected either into the axial end of the filter or through the side of the smokable device, such as through a cannula attached to an injection device. Preferably, the injection device meters the amount of material administered per each injection.

Alternately, the dry water and porphyrin mixture can be included in a filter extension for attachment to a conventional smokable device such as a standard cigarette, or to a cigarette filter by the smoker. The filter extension comprises a layer of dry water and porphyrin and, preferably, a fibrous material as a matrix. The filter extension further comprises a sleeve which extends axially forward for fitting over the proximal end of the smokable device. The sleeve is bounded by a porous retaining element to maintain the dry water and porphyrin within the filter extension. Preferably, the sleeve further comprises a length of conventional filter material such that, upon connection to the smokable device, the filter extension and smokable device appear to substantially be a conventional smokable device.

Filters Containing a Metal Phthalocyanine with or without a Cationic Polymer

According to another embodiment of the present invention, there is provided a cigarette filter comprising one or more than one metal phthalocyanine, such as for example a porphyrin such as chlorophyll, with or without other substances disclosed herein. Preferably, the metal phthalocyanine is an iron-containing porphyrin or a copper-containing porphyrin, such as chlorophyllin and copper phthalocyanine trisulfonate (copper phthalocyanine, copper phthalocyanate).

Porphyrins are planar compounds which inactivate several classes of mutagens and carcinogens. Porphyrins inactivate planar mutagens and carcinogens primarily by binding the carcinogen to the planar porphyrin structure through hydrophobic interactions. Therefore, porphyrins ideally need to be maintained in aqueous environments to optimally adsorb these tobacco smoke carcinogens. Porphyrins further inactivate carcinogens by binding polycyclic aromatic hydrocarbons (PAH) through π—π (pi—pi) bonding. The copper-containing porphyrins also inactivate many classes of non-planar mutagens and carcinogens including some nitrosamines through reaction with the copper ion. While known to inactivate various carcinogens, it has not been known how to effectively utilize porphyrins in tobacco smoke filters.

Chlorophyllin is a naturally occurring, copper-containing porphyrin and is the stable form of chlorophyll in which the magnesium present in chlorophyll has been replaced by copper. Chlorophyllin has the following formula:

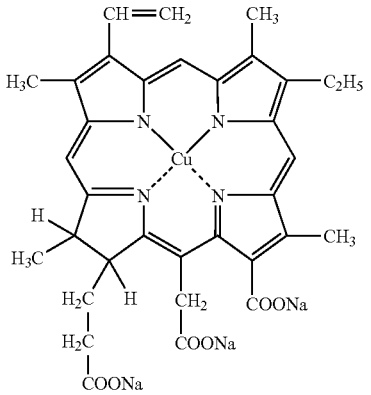

Chlorophyllin

Chlorophyllin, however, is difficult to chemically link to tobacco smoke filter components. Therefore, in a preferred embodiment, the copper-containing porphyrin incorporated into the tobacco smoke filter is copper phthalocyanine. Copper phthalocyanine is a nontoxic, synthetic chlorophyllin analog which can be more easily linked to tobacco smoke filter components than chlorophyllin. Copper phthalocyanine has the following formula:

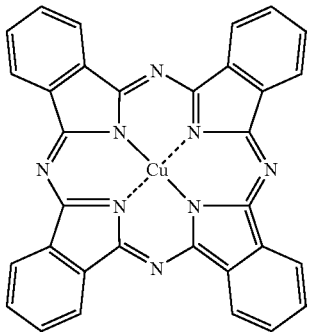

Cu-Phthalocyanine

Copper phthalocyanine can be incorporated into a tobacco smoke filter by directly adding the copper phthalocyanine to the tobacco smoke filter. In a preferred embodiment, the copper phthalocyanine can be incorporated into a tobacco smoke filter as a covalently bound ligand to cotton, such as "blue cotton," to rayon, such as "blue rayon," or to other suitable material. In another preferred embodiment, copper phthalocyanine can be incorporated into a tobacco smoke filter in combination with other tobacco smoke filter embodiments of the present invention. In one embodiment, copper phthalocyanine is attached to cellulosic fibers in the form of the dye C.I. Reactive Blue 21, as described in Hayatsu, Journal of Chromatography, 597:37–56 (1992), incorporated herein by reference in its entirety, which forms a stable ether linkage to free hydroxyl groups on cellulosic fibers or other materials under mild conditions (unlike chlorophyllin and other porphyrins), thereby yielding "Blue 21 Cellulose." In another embodiment, copper phthalocyanine is attached to cellulosic fibers in the form of the dye ORCO Turquoise Blue GGX, yielding "GGX Cellulose." Both dyes were obtained from Organic Dyestuffs Corporation (ORCO), East Providence, R.I. US.

Cellulose is the base material used to manufacture tobacco smoke filters. The standard form of cellulose used for manufacturing tobacco smoke filters is cellulose acetate fibers, made by treating cellulose with acetic anhydride. This reaction replaces the free hydroxyl groups present on natural cellulose with more hydrophobic acetate groups. The cellulose acetate is then treated with triacetin (glycerol triacetate), a solvent that joins some of the cellulose acetate fibers together because cellulose acetate, unlike cellulose, is partially soluble in triacetin. Disadvantageously, however, replacing the hydroxyl groups with acetate groups and treating the cellulose with triacetin greatly diminishes the number of potential attachment sites for copper-containing porphyrin molecules and renders triacetin treated-cellulose acetate less desirable as a base material for tobacco smoke filters than untreated cellulose.

Therefore, according to one embodiment of the present invention, there is provided a tobacco smoke filter comprising one or more than one segment, that is, at least a first segment. The first segment comprises copper-containing porphyrin and cellulose that has not been treated with acetic anhydride or triacetin. Preferably, the tobacco smoke filter further comprises a second segment that comprises cellulose acetate treated with triacetin but that is substantially free of copper-containing porphyrin.

According to one embodiment of the present invention, there is provided a method of making a tobacco smoke filter comprising a copper phthalocyanine. By way of example only, the method was performed as follows. The dyes were added to the cellulosic fibers by, first, adding 20 g of cellulose to 400 ml of distilled water. Then, 20 g of sodium sulfate was added and dissolved, followed by 2.4 grams of dye. Next, 8 g of sodium carbonate was added while stirring and the mixture was heated to about 30° C. for 35 minutes. Then, the temperature was increased to 70° C. for an additional 60 minutes to complete the covalent binding of the copper-containing porphyrin to the cellulose fiber. Next, the mixture was collected on a mesh and rinsed thoroughly under distilled water and, finally with 200 ml of ethanol, yielding cellulose pulp with covalently bound, copper-containing porphyrin, which was allowed to dry at room temperature. Though specific reaction times and temperatures are given in this disclosure by way of example, variation of parameters of reaction time and temperature are possible, in accord with known procedures in the attachment of vinyl sulphone reactive dyes to textiles, as will be understood by those with skill in the art with reference to this disclosure. In a preferred embodiment, the copper phthalocyanine is present in an amount of from about 0.1 to about 5% by dry weight of the filter whether free or covalently bound. In a particularly preferred embodiment, the copper phthalocyanine is present in an amount of from about 1 to about 3% by dry weight of the filter.

In one embodiment of the present invention, there is provided a smokable device comprising a body of divided tobacco affixed to a tobacco smoke filter comprising the first segment. Preferably, the smokable device comprises the first segment adjacent the body of divided tobacco and a second segment adjacent that is at the proximal end of the smokable device. This configuration advantageously allows a user of the smokable device to draw smoke directly through the second segment of the tobacco smoke filter, thereby obtaining a convention feel while using the smokable device.

In another embodiment of the present invention, there is provided a method of making a tobacco smoke filter as disclosed in this disclosure. The method produces a tobacco smoke filter comprising copper-containing porphyrin, such as copper phthalocyanine, that tends to stay uniformly dispersed in the filter during the manufacturing process and as moisture accumulates in the filter during the burning of the tobacco, and that tends not to leach out of the filter during use.

The method comprises preparing the filter material from cellulose or from other materials to which one or more than one copper-containing porphyrin has been covalently bound. The filter material is then made into tobacco smoke filters comprising at least one segment of the material with covalently bound, copper-containing porphyrin. The tobacco smoke filter can also comprise one or more than one segment of material that is substantially free of copper-containing porphyrin. The use of filter material comprising covalently bound, copper-containing porphyrin permits high speed, high-volume manufacturing of smokable devices, such as cigarettes, incorporating a filter according to the present invention using existing equipment.

The method comprises the steps of, first, providing one or more than one copper-containing porphyrin, such as copper phthalocyanine. In a preferred embodiment, the copper-containing porphyrin is a vinylsulfone derivative of copper phthalocyanine trisulfonate, such as C.I. Reactive Blue 21 dye (ORCO® REACTIVE Turquoise RP, available from Organic Dyestuffs Corporation, East Providence, R.I. US).

The amounts of material given in the following steps are relative amounts and are for example, only. The amounts would be scaled upward for commercial production as will be understood by those in the art with reference to this disclosure. After providing the copper-containing porphyrin, a mixture is produced comprising a ratio of about 1.2:10 copper-containing porphyrin to cellulose fiber by weight, such as approximately 1.2 g of the copper-containing porphyrin and approximately 10 g of cellulose fiber of a grade suitable for use as paper-making pulp. The mixture further preferably comprises approximately 10 g of sodium sulfate in approximately 200 ml of chlorine-free water.

Then, the mixture is heated to about 30° C. for about 35 minutes, after which, the temperature is raised to about 70° C. for about 60 minutes to complete the covalent binding of the copper-containing porphyrin to the cellulose fiber. Next, the mixture is collected on a mesh and rinsed thoroughly under running tap water, producing cellulose fiber with covalently bound, copper-containing porphyrin. The cellulose fiber with covalently bound, copper-containing porphyrin is then formed into a segment of a tobacco smoke filter using commercially available equipment. The filter is then attached to a body of divided tobacco to produce a smokable device according to the present invention. Additionally, the present invention comprises copper-containing porphyrin impregnated paper made as disclosed above, for use in making tobacco smoke filters or for other uses.

For commercial-scale manufacturing, the covalent binding reaction for attaching a reactive metal porphyrin, such as C.I Reactive Blue 21, is preferably performed in a pulp-attrition tank, such as those present in a papermaking facility. Further preferably, the covalent binding reaction begins at a pulp load of between about 5% and 10% in water. Typically, cellulose fiber used for fabricating cigarette filter paper is diluted to between about 0.2 to 0.5% prior to collection on papermaking screens. It is possible to eliminate this separate step after the covalent binding reaction by diluting the porphyrin bound, cellulose fiber directly, before proceeding with the standard process of papermaking.

The method of making a tobacco smoke filter can further comprise adding one or more than one additional substance to the tobacco smoke filter of the present invention in addition to copper-containing porphyrin. In a preferred embodiment, the one or more than one additional substance is chitin, a polysaccharide derived from the shells of arthropods, because chitin particles comprise a high density of free hydroxyl groups that can be covalently attached to metal-porphyrin compounds, such as C.I. Reactive Blue 21 dye. By dry weight, chitin can be covalently bound to about four times as much C.I. Reactive Blue 21 dye as an equivalent amount of cellulose. In a preferred embodiment, chitin granules (available from Sigma Chemical Company, St. Louis, Mo. US) are covalently bound to copper-containing porphyrin in method equivalent to the reaction disclosed above in which the cellulose is replaced with chitin. The amounts of material given in the following steps are relative amounts and are for example, only. For commercial production, the amounts are scaled upward, as will be understood by those in the art with reference to this disclosure. The covalent binding of chitin granules to copper-containing porphyrin can be accomplished by, for example, dissolving 0.8 g C.I. Reactive Blue 21 dye and 6.8 g sodium sulfate in 133 ml of distilled water. Then, 2.0 g of chitin are added and the mixture is stirred gently for 20 minutes at 30° C. Next, 2.7 g of sodium carbonate are added and the mixture is allowed to stand at 30° C. for 15 minutes and is then heated from 30° C. to 70° C. over the course of 20 minutes. The mixture is then stirred while maintaining a temperature of 70° C. for 60 minutes, to allow the binding reaction to go to completion. The resulting copper phthalocyanine-derivatized chitin is collected in a sintered glass filter and rinsed thoroughly with distilled water to remove unreacted porphyrin and the salts.

The copper-containing porphyrin covalently bound to chitin can be incorporated into paper by mixing it with cellulose pulp in a ratio of between about 1:20 and about 1:1 copper-containing porphyrin covalently bound to chitin to cellulose pulp by dry weight. The cellulose can also comprise covalently bound copper-containing porphyrin according to the present invention. The incorporation comprises mixing the chitin with cellulose pulp in the initial step of paper making, as the cellulose is being macerated in water (before the pulp is laid out on a mesh, pressed and dried). The chitin-impregnated cellulose can then be used for manufacture of tobacco smoke filters according to the present invention.

In a preferred embodiment, the one or more than one additional substance is activated charcoal or is lignin (a constituent of wood produced as a byproduct of preparation of cellulose paper pulp from wood). Either or both of these substances can be added to cellulose covalently bound to copper-containing porphyrin according to the present invention, especially for fabrication of paper incorporating activated charcoal or lignin. When present, activated charcoal or lignin is added to the cellulose in the same manner and ratio as chitin disclosed above.

Further, in a preferred embodiment the filter produced as disclosed above is attached to a tobacco smoke filter made of standard cellulose acetate fibers treated with triacetin to produce a filter comprising at least two segments. Preferably, the segment comprising cellulose acetate fibers treated with triacetin is proximal, that is, away from the lit end of the smokable device, to the segment comprising copper-containing porphyrin impregnated cellulose fibers, and the segment comprising copper-containing porphyrin impregnated cellulose fibers is between the body of divided tobacco and the segment comprising cellulose acetate fibers treated with triacetin.

The effectiveness of a two-segment filter made according to the present invention was tested as follows. Tobacco smoke filters were prepared comprising two segments. Each proximal segment comprised cellulose acetate fibers treated with triacetin. The distal segment of one filter comprised copper phthalocyanine impregnated cellulose fibers as disclosed above, while the distal segment of the other filter comprised cellulose fibers that were not treated with triacetin and that were not impregnated with a copper-containing porphyrin. The two segment filters were then placed in plastic tubing leaving approximately 0.5 cm of the tube without the filter, and a 3 cm long rod of tobacco from a Marlboro® cigarette was fitted into the 0.5 cm empty end of the tubing abutting the filter to create smokable devices. The tobacco was lit and the smokable devices were subjected to ten 20 ml puffs with a suction pump, until the tobacco was burned down flush with the end of the plastic tube. The filters were removed from the tubes and placed in 10 ml of methanol containing ammonia in a 50:1 dilution to elute the retained polycyclic aromatic hydrocarbons from the filters. The 10 ml extracts were evaporated down to 1 ml and subjected to thin layer chromatography on aluminum oxide with 5 ml hexane. Total polycyclic aromatic hydrocarbon content was estimated spectrofluorimeterically. The results indicated that the two-segment filter comprising copper phthalocyanine according to the present invention retained 80 ng of polycyclic aromatic hydrocarbons while the two-segment filter without copper phthalocyanine retained 6 ng of polycyclic aromatic hydrocarbons. This 13-fold increase is particularly significant in that the total polycyclic aromatic hydrocarbons produced during combustion of the tobacco rod is estimated to be between about 100 ng and 200 ng. Therefore, the two-segment filter according to the present invention removed between about 40% and 80% of the total amount of polycyclic aromatic hydrocarbons from the tobacco smoke.

In another embodiment, the tobacco smoke filter of the present invention comprises an iron analog of the copper-containing porphyrin rather than the copper-containing porphyrin. In a preferred embodiment, the analog is an iron analog of C.I. Reactive Blue 21 dye produced by acidification of the C.I. Reactive Blue 21 dye, addition of iron sulfate and then addition of a suitable base, as will be understood by those in the art with reference to this disclosure. Alternately, an iron salt, such as anhydrous iron chloride, can be used instead of a copper salt during initial synthesis of C.I. Reactive Blue 21 dye to produce an iron analog. The iron analog of C.I. Reactive Blue 21 dye can also be used to make paper impregnated with iron analog of C.I. Reactive Blue 21 dye, corresponding to the copper-containing porphyrin impregnated paper as disclosed above, for use in making tobacco smoke filters or for other uses.

In another embodiment, the present invention is a tobacco smoke filter comprising both one or more than one metal phthalocyanine, such as an iron phthalocyanine or a copper phthalocyanine, and one or more than one polycationic polymer. In a preferred embodiment, the one or more than one polycationic polymer has a cationic moiety comprising one or more than one primary or secondary amino group. In one embodiment, the one or more than one polycationic polymer is selected from the group consisting of poly (propyleneimine), polyvinylamine, poly(2-ethylaziridine), poly(2,2-dimethylaziridine, and poly(2,2-dimethyl-3-n-propylaziridine) and a combination of the preceding. In a preferred embodiment, the one or more than one polycationic polymer is polyethyleneimine (PEI). The one or more than one polycationic polymer, such as PEI, is effective at removing mutagens and carcinogens, and other toxins, from tobacco smoke. It also functions to allow total nicotine to pass through the filter unimpeded, thus increasing the ratio of nicotine delivery to the delivery of mutagens and carcinogens.

While the metal porphyrins incorporated into the tobacco smoke filters of the invention trap or inactivate mutagens and carcinogens in tobacco smoke, the metal porphyrins can also reduce nicotine passthrough. As disclosed in this disclosure, in a preferred embodiment the metal porphyrin incorporated into the tobacco smoke filter comprises one or more than one anionic moieties, such as the sulfonate groups attached to the porphyrin ring of C.I. Reactive Blue 21 dye. The polycationic polymer appears to act in part by neutralizing the effect of the sulfonate groups on nicotine retention in the filter. Therefore, adding a polycationic polymer to cellulose derivatized with a metal porphyrin decreases the amount of nicotine retained in the filter, and increases the amount of nicotine in the tobacco smoke but without countering the effect of the metal porphyrin on trapping or inactivating mutagens and carcinogens in the tobacco smoke. Thus, the combination of a metal porphyrin and a polycationic polymer in the tobacco smoke filter of the present invention act synergistically to decrease the ratio of mutagenic and carcinogenic compounds to nicotine in the tobacco smoke better than does either a metal porphyrin or a polycationic polymer does alone. Further, because tobacco smokers tend to adjust their smoke inhalation to self-administer a satisfactory dose of nicotine, a decrease in the ratio of mutagenic and carcinogenic compounds to nicotine will tend to reduce the total amount of mutagenic and carcinogenic compounds inhaled by smokers. A decrease in the amount of mutagenic and carcinogenic compounds taken in by the smoker should lead to a decrease in the morbidity and mortality associated with smoking tobacco.

Polycationic polymers, such as PEI, are available in a range of molecular weights according to the number of monomers per molecule. In a preferred embodiment of the present invention, the polycationic polymer used in the filter of the present invention has a molecular weight greater than about 1000 Daltons to reduce the possibility that the polycationic polymer could enter into the tobacco smoke. In a particularly preferred embodiment, the polycationic polymer used in the filter has a molecular weight of between about 1000 and 100,000 Daltons.

Disadvantageously, however, polycationic polymers, such as PEI, are not physically compatible with cellulose acetate fibers. Therefore, according to one embodiment of the present invention, there is provided a tobacco smoke filter comprising cellulose that is substantially free of cellulose acetate, rather than cellulose, and comprising both a metal phthalocyanine, such as an iron phthalocyanine or a copper phthalocyanine, and comprising a polycationic polymer, such as PEI.

For commercial-scale production, solutions of polycationic polymer in water or short chain alcohols (e.g., ethanol or isopropanol) are sprayed onto paper intended for filter manufacture. The polycationic polymer solution is sprayed as paper from a roll is being pulled into a crimper, or at an earlier stage, such as during the initial papermaking process after pulp is laid out onto papermaking screens. In one embodiment, the concentration of polycationic polymer in solution is between about 0.5 and 50%. In a preferred embodiment, the concentration of polycationic polymer in solution is between about 1 and 10%. In a preferred embodiment, the polycationic polymer can be added during the papermaking process, before the pulp is laid onto papermaking screens.

A tobacco smoke filter according to this embodiment of the present invention was produced by constructing dual zone filters comprising a segment of standard cellulose acetate filter material at the proximal end of the filter and a segment of cellulose dyed with a metal phthalocyanine dye and treated with PEI at the distal end of the filter as follows. First, cellulose was obtained by shredding paper used in the manufacture of paper filters (Tela-Kimberly Switzerland GmbH, Balsthal, Switzerland). PEI was obtained as a viscous 50/50 solution in water (Catalog # P3143, Sigma Chemical Co., St. Louis, Mo. US). The PEI solution was diluted with ethanol to a final concentration of 5% PEI (in 5% water, 90% ethanol). 10 ml of this PEI solution in ethanol was sprayed on 10 grams of Blue 21 Cellulose pulp. The pulp was immediately macerated in a rotating-blade coffee bean grinder until it had a texture resembling loose cotton and was allowed to dry at room temperature. 10 grams of GGX Cellulose were likewise treated with 10 ml of 5% PEI in ethanol/water.

Next, dual filters were prepared by removing filters from Marlboro® light cigarettes (Philip Morris, Richmond, Va. US) with forceps. The filters were 27 mm long. A thin-walled plastic tube that fit tightly into the filter cavity of the cigarette was cut into 27 mm segments. The original cellulose acetate filter was cut into 1 cm segments. A 1 cm piece of cellulose acetate filter was inserted into the plastic tube, and the remainder was filled with 85 mg of macerated cellulose (with or without metal phthalocyanine dye or PEI). The tube containing the cellulose acetate and cellulose was inserted into the filter cavity of the cigarettes from which the filters had been removed with the cellulose segment in contact with the tobacco column, such that the standard cellulose acetate material was at the proximal end of the cigarette, that is, the end normally in contact with a smoker's lips. As a control, test cigarettes of untreated cellulose acetate filters were made by inserting the original filter into a 27 mm length of the plastic tube, which was then reinserted into the cigarette filter cavity. The plastic tube served to block ventilation holes in the paper surrounding the filter that affect smoke composition by diluting it with air.

Referring now to Table 2, there are shown the results of tar (as a representative of mutagenic compounds) and nicotine measurements in particulate matter captured on Cambridge filters from smoke obtained from the groups of cigarettes (3 replicates comprising 5 cigarettes each per test group). The smoking conditions used were 35 ml/puff, 2 second puff duration, and one puff every sixty seconds. Because all filters, including the standard cellulose acetate filter, were encased in plastic tubes that were inserted into the filter cavities, ventilation holes in the filter (that would otherwise dilute the smoke with air during passage through the filter) were blocked. The following groups of filters were tested: 1) cellulose acetate (ca); 2) cellulose acetate/cellulose dual zone filter; 3) cellulose acetate/blue cellulose dual zone filter; 4) cellulose acetate/blue cellulose dual zone filter with 5% PEI added; 5) cellulose acetate/GGX cellulose dual zone filter; 6) cellulose acetate/GGX cellulose dual zone filter with 5% PEI added.

TABLE 2

Tar and Nicotine Content of Tobacco Smoke Passed Through Filters (Mean in mg/filter ± SD)

| Test Filter | Tar | Nicotine | Nicotine/Tar Ratio |
|---|---|---|---|
| Cellulose Acetate (CA) | 11.1 ± 0.9 | 0.75 ± 0.07 | 0.0677 |
| CA/Cellulose | 8.27 ± 0.82 | 0.53 ± 0.04 | 0.0645 |
| CA/Blue 21 Cellulose | 7.09 ± 1.14 | 0.45 ± 0.07 | 0.0639 |
| CA/Blue 21 Cellulose + PEI | 8.81 ± 0.45 | 0.68 ± 0.02 | 0.0777 |

TABLE 2-continued

Tar and Nicotine Content of Tobacco Smoke Passed Through Filters (Mean in mg/filter ± SD)

| Test Filter | Tar | Nicotine | Nicotine/Tar Ratio |
|---|---|---|---|
| CA/GGX Cellulose | 7.23 ± 1.16 | 0.45 ± 0.06 | 0.0621 |
| CA/GGX Cellulose + PEI | 8.40 ± 1.38 | 0.65 ± 0.07 | 0.0779 |

As can be seen, the addition of PEI to the Blue 21 cellulose filter and to the GGX cellulose filter resulted in a significant increase in the ratio of nicotine to mutagenic compounds represented by tar.

Additionally, the total amount of particulate matter (TPM) from additional test cigarettes from each group was collected on a Cambridge filter using the same smoking protocol and dissolved in DMSO at a concentration of 10 mg/ml. Further, an Ames mutagenesis assay was conducted on the DMSO extract of collected smoke particulate matter in the TA98 strain of *Salmonella*, with S9 liver extract activation. Two doses of smoke extract were tested, 250 and 500 micrograms/plate. In the Ames Test, the number of bacterial colonies ("revertants") per plate is an index of the mutagenic activity of the cigarette smoke extract, and the mutagenic activity is in turn a reflection of the carcinogenic potential. The results of these tests are given in Table 3.

TABLE 3

Mutagenic Activity of Total Particulate Matter from Smoke Passed Through Filters (Mean ± SD)

| Test Filter | Revertants | Revertants | Ratio versus CA |
|---|---|---|---|
| Cellulose Acetate (CA) | 453 ± 20 | 639 ± 12 | 1.00 |
| CA/Cellulose | 438 ± 16 | 669 ± 25 | 1.05 |
| CA/Blue 21 Cellulose | 378 ± 15 | 506 ± 18 | 0.79 |
| CA/Blue 21 Cellulose + PEI | 351 ± 22 | 474 ± 18 | 0.74 |
| CA/GGX Cellulose | 397 ± 13 | 551 ± 25 | 0.82 |
| CA/GGX Cellulose + PEI | 401 ± 13 | 520 ± 31 | 0.77 |

As can be seen, the ratio of mutagenic activity, an index of carcinogenic potential, to total particulate matter (primarily tar+nicotine) is decreased relative to untreated cellulose acetate by passing the smoke through filters containing cellulose derivatized with either CI Reactive Blue 21 dye or Reactive Turquoise GGX dye. PEI further decreased the ratio of mutagenic activity to smoke TPM. Therefore, the addition of PEI to filter materials derivatized with metal phthalocyanine dyes increases the ratio of nicotine to tar and decreases the ratio of mutagenic activity to tar, resulting in a greater increase in the ratio of nicotine to mutagenic activity in smoke greater than is achieved with tobacco smoke filter comprising a metal phthalocyanine without PEI both by allowing nicotine to pas through the filing unimpeded and by maintaining mutagens and other toxins within the filter.

Further, the TPM/revertant ratio can be used as an index of the mutagenic activity of a given amount of TPM. The following calculations use the data from the 500 microgram/plate tests, above.

The cellulose acetate filter group had an average of 639 revertants (mutated bacterial colonies). Therefore, in the Ames test, 500 micrograms of TPM yielded 639 revertants= 0.783 micrograms of TPM per revertant. The cellulose acetate (CA) filter group had a ratio of nicotine to tar of 0.0677, that is, 0.0677 micrograms of nicotine per microgram of tar. The Blue 21 with PEI filter group had a mean of 474 revertants at the same absolute dose of tar of 500 micrograms/plate, that is, 1.055 micrograms of tar/revertant. The Blue 21 with PEI filter group yielded a nicotine/tar ratio of 0.0777, that is, 0.0777 micrograms of nicotine/microgram of tar.

Thus, multiplying the tar/revertant ratio by the nicotine/tar ratio gives the nicotine/revertant ratio, which is an index of the amount of mutagenic activity per unit of nicotine, as follows:

Cellulose Acetate: 0.783×0.0677=0.053 micrograms of nicotine/revertant (or 18.9 revertants/microgram of nicotine)

Blue 21 with PEI: 1.055×0.0777=0.082 micrograms of nicotine/revertant (or 12.2 revertants per microgram of nicotine)

Blue 21 with PEI compared to Cellulose Acetate yields a ratio of 0.082/0.053=1.54

Therefore, adding PEI to a cellulose filter derivatized with Blue 21 resulted in a 54% increase in the ratio of nicotine to mutagenic activity compared with a standard untreated cellulose acetate filter.

In other embodiments of the present invention, one or more than one pH-modifying filter additive, other than PEI, or in addition to PEI, are added to the filter. In one embodiment, the one or more than one pH-modifying filter additive is an inorganic salt selected from the group consisting of sodium carbonate, calcium carbonate, sodium phosphate, calcium phosphate and a cationic ion exchange resin.

In another embodiment of the present invention, the tobacco smoke filter comprises chitin in addition to one or more than one polycationic polymer, such as PEI. In another embodiment of the present invention, the tobacco smoke filter comprises chitin in addition to one or more than one polycationic polymer, such as PEI, and one or more than one metal phthalocyanine, such as C.I. Reactive Blue 21 dye.

Filter Containing Microcapsules

According to another embodiment of the present invention, there is provided a filter for tobacco smoke comprising a porous substrate having microcapsules dispersed in the porous substrate, with or without other substances disclosed in this disclosure. The microcapsules preferentially include an inner core with an outer shell.

The cores of the microcapsules comprise at least one vegetable oil. Suitable vegetable oils include at least one oil selected from the group consisting of castor oil, cotton seed oil, corn oil, sunflower oil, sesame oil, soybean oil, and rape oil. In a preferred embodiment, the vegetable oil is safflower oil. Other oils are also suitable, as will be understood by those with skill in the art with reference to this disclosure. In a preferred embodiment, the vegetable oil is present in an amount of from about 20% to about 80% by dry weight of the microcapsules, and more preferably from about 30% to about 70% by dry weight of the microcapsules.

In a preferred embodiment, the microcapsule cores also contain a porphyrin, such as chlorophyllin, or another porphyrin such copper phthalocyanine. When present, the chlorophyllin is preferably present in an amount of from about 1% to about 10% by dry weight of the microcapsules, and more preferably from about 2% to about 5% by dry weight of the microcapsules.

In a preferred embodiment, the microcapsule shells comprise a humectant. In a preferred embodiment, the humectant is sodium pyroglutamate, though other humectants can be used as will be understood by those with skill in the art with reference to this disclosure. In a preferred embodiment, the humectant, such as sodium pyroglutamate, is present in an amount of from about 10% to about 90% by dry weight of the microcapsules, and more preferably from about 20% to about 70% by dry weight of the microcapsules.

In another preferred embodiment, the microcapsule shells also comprise methylcellulose. In a preferred embodiment, the methylcellulose is present in an amount of from about 5% to about 30% by dry weight of the microcapsules, and more preferably from about 10% to about 25% by dry weight of the microcapsules.

In another preferred embodiment, the microcapsule shells comprise a polymeric agent such as polyvinylalcohol or polyvinyl pyrrolidone, or can comprise both polyvinylalcohol and polyvinyl pyrrolidone, in addition to methylcellulose or in place of methylcellulose. In a preferred embodiment, the polymeric agent is present in an amount of from about 2% to about 30% by dry weight of the microcapsules, and more preferably from about 5% to about 20% by dry weight of the microcapsules.

Compounds used in formulation of microcapsules according to the present invention are available from a variety of sources known to those with skill in the art, such as Sigma Chemical Co., St. Louis, Mo. US.

Microcapsules suitable for use in the present invention can be made according to a variety of methods known to those with skill in the art. For example, microcapsules according to the present invention can be produced by combining 200 g of vegetable oil with 500 g of an aqueous suspension comprising 25 g of low-viscosity methylcellulose, 5 g of chlorophyllin, 50 g of sodium pyroglutamate and 150 g of corn starch in water. The mixture is emulsified and spray-dried to form microcapsules.

Microcapsules according to the present invention can be formed by spray drying methods at the site of cigarette manufacturing machinery by spraying onto sheets of cellulose acetate filter tow before the tow is formed into cylindrical filters. Alternatively, suitable microcapsules can be premanufactured and added to sheets of cellulose acetate filter tow by dropping the microcapsules onto the tow with a vibrating pan or by other techniques as will be understood by those with skill in the art with reference to this disclosure. Further, microcapsules can be incorporated into prefabricated filters by sprinkling the microcapsules into the filter tow before the tow is rolled and shaped in rods of filter material.

As will be appreciated by those with skill in the art, the manufacture of filters containing microcapsules according to the present invention will require only minor modification of conventional filter-cigarette manufacturing equipment. Further, the manufacture of filters containing microcapsules according to the present invention is only marginally more expensive than conventional filters.

In use, the humectant portions of the microcapsules trap moisture from tobacco smoke passing through the filter. Sodium pyroglutamate is particularly preferred because it can be incorporated into the filter in a dry form.

When present, the oil portions of the microcapsules trap certain harmful volatile compounds like pyridine without impeding the flow of flavor and aroma producing compounds. When present, chlorophyllin is a potent inactivator of carcinogenic components of tobacco smoke.

The methylcellulose portions of the microcapsules impart structural stability to the microcapsules but disperse upon warming and when exposed to moisture. Unlike most commonly used viscosity-imparting substances, methylcellulose precipitates from warm solutions. Further, it is soluble at lower temperatures than most commonly used viscosity-imparting substances.

When tobacco smoke filters containing microcapsules comprising a shell of sodium pyroglutamate and methylcellulose and a core of vegetable oil and chlorophyllin, according to the present invention, filter tobacco smoke, the microcapsules capture heat and moisture from the tobacco smoke. The methylcellulose precipitates into a fibrous material which increases the effective surface area available for wet-filtration of the tobacco smoke. This allows the moisture retained by the sodium pyroglutamate to rapidly disperse into the filter material. The chlorophyllin partitions approximately evenly between the aqueous and oil environments, allowing increased inactivation of both particulate and vapor-phase toxic and mutagenic compounds of tobacco smoke than if the chlorophyllin was available in only one phase.

Filters Containing a Surfactant

In another preferred embodiment, the filters of the present invention additionally comprise at least one surfactant to improve the effectiveness of the tobacco smoke filter, with or without other substances disclosed in this disclosure. In a particularly preferred embodiment, the surfactant is present in an amount of from about 0.1% to about 10%, and more preferably from about 0.1% to about 2% by weight of the filter.

The surfactant is preferably nontoxic and can include one or more of the following classes of compounds: (1) a polyoxyalkylene derivative of a sorbitan fatty acid ester (i.e., polyoxyalkylene sorbitan esters), (2) a fatty acid monoester of a polyhydroxy-alcohol, or (3) a fatty acid diester of a polyhydroxy alcohol, though other suitable surfactants will be understood by those with skill in the art with reference to the disclosure in this disclosure. Examples of suitable surfactants include ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, and poly(oxyethylene-consist of-oxypropylene). Other suitable surfactants can also be used as will be understood by those with skill in the art with reference to the disclosure in this disclosure.

Filters Containing an Additional Substance

The filter can additionally include one or more other substances which filter or inactivate toxic or mutagenic components of tobacco smoke. Examples of such substances include antioxidant and radical scavengers such as glutathione, cysteine, N-acetylcysteine, mesna, ascorbate, and N,N'-diphenyl-p-phenyldiamine; aldehyde inactivators such as ene-diol compounds, amines, and aminothiols; nitrosamine traps and carcinogen inactivators such as ion-exchange resins, chlorophyll; and nicotine traps such as tannic acid and other organic acids. In one preferred embodiment, the filter includes colloidal silica, a compound which can scavenge secondary amines from tobacco smoke, thereby preventing conversion of the secondary amines to nitrosamines in the body. Other suitable substances can also be used as will be understood by those with skill in the art with reference to the disclosure in this disclosure. In a preferred embodiment, the other substances are present in an amount of from about 0.1 to about 10%, and more preferably from about 0.1 to about 2% by weight of the filter.

Filters Having Certain Combinations of Substances Disclosed in this Disclosure

According to another embodiment of the present invention, there is provided a tobacco smoke filter comprising combinations of substances disclosed in this disclosure. In a preferred embodiment, the filter comprises a humectant, such as sodium pyroglutamate, in combination with dry water. This combination functions synergistically to improve wet-filtration of tobacco smoke. In one embodiment, the filter comprises sodium pyroglutamate in an amount of between about 1% and 20% of the aqueous portion of the dry water by weight. In a preferred embodiment, the filter comprises sodium pyroglutamate in an amount of between about 5% and 10% of the aqueous portion of the dry water by weight.

In another preferred embodiment, the filter comprises a copper-containing porphyrin, such as copper phthalocyanine, in combination with a humectant such as sodium pyroglutamate, dry water or both. These combinations are particularly preferred because copper-containing porphyrins scavenge carcinogens better in aqueous environments. In one embodiment, the copper-containing porphyrin comprises between about 0.5% to about 5% of the dry water by weight.

In another preferred embodiment, the filter comprises chlorophyllin, in combination with a humectant, dry water or both. In one embodiment, the chlorophyllin comprises between about 0.5% to about 5% of the dry water and the humectant is between about 1% and 20% of the dry water by weight.

A specific example of such a combination would be blue rayon (copper phthalocyanine impregnated rayon) combined with dry water. When present in an amount between about 10 mg to 100 mg in the 3 mm tobacco end of a standard cellulose acetate tobacco smoke filter, the combination does not impair draw but reduces mutagenicity of tobacco smoke 75–80% by the Ames test. Further, these components are inexpensive, safe, and not harmful to the environment.

Combinations of dry water and porphyrin are produced, for example, by adding dry porphyrin in amounts up to the amount of methylated silica by weight to dry water, made according to the description in this disclosure. The porphyrin must be added after the dry water has been stably emulsified. Dissolution of porphyrin in water prior to emulsification in methylated silica results in an unstable porphyrin/dry water compound. In a preferred embodiment, the porphyrin is added in amounts of about 0.1 to 0.5 grams per gram of methylated silica. A similar method is used to produce the combination of dry water and porphyrin-derivatized fiber, such as blue cotton or blue rayon. After combining the two substances, the combination is shaken or stirred to homogeneity.

Filters Having a Circumferential Barrier

Filters according to the present invention are preferably provided with an exterior, circumferential, moisture-impervious barrier or casing to prevent wetting of the smoker's hands. Such a barrier can be made from a polymeric material such as ethylvinyl acetate copolymer, polypropylene, or nylon, as is understood by those with skill in the art.

Position of Substances within Filters

The substances disclosed in this disclosure can be incorporated into filters according to the present invention in a variety of configurations. For example, the substance or substances can be dispersed throughout the filter in a substantially uniform manner. Alternately, the substance or substances can be dispersed in only one segment of the filter such as in the proximal half (the end nearest the smoker), the distal half (the end nearest the tobacco), the proximal third (the end nearest the smoker), in the middle third or in the distal third (the end nearest the tobacco). For example, the tobacco smoke filter can have one or more than one segment comprising both one or more than one metal phthalocyanine and one or more than one polycationic polymer, and one or more than one segment that is substantially free of both a metal phthalocyanine and a polycationic polymer.

In another embodiment, at least one substance is dispersed in one segment of the filter and at least one other substance is dispersed in a different segment of the filter. The two segments can have overlapping areas. For example, a filter according to the present invention can have a metal phthalocyanine dispersed in the distal third of the filter and a polycationic polymer dispersed in the proximal third of the filter, with a middle segment comprising both a metal phthalocyanine and a polycationic polymer.

In another embodiment, the substance or substances can be incorporated into a filter that is then affixed to an end of a standard tobacco smoke filter. In a preferred embodiment, the substance or substances are incorporated into a tobacco smoke filter that resembles a shortened version of a standard tobacco smoke filter, and the shortened filter is then affixed to an end of a standard tobacco smoke filter. In this embodiment, the user will not be overtly aware of the additional shortened filter because of its resemblance in construction to a standard filter, unlike commercially available filters which add onto the proximal end of a smokable device.

Further, the substance or substances according to the present invention can be incorporated into a layer of the filter between the fibrous material making up the remainder of the filter, and the body of divided tobacco.

Smokable Devices Incorporating Filters According to the Present Invention

According to another embodiment of the present invention, there is provided a smokable device comprising a tobacco smoke filter as disclosed in this disclosure affixed to a body of divided tobacco. For example, such a smokable device can be a cigarette incorporating a filter containing both one or more than one metal phthalocyanine and one or more than one polycationic polymer.

Method of Filtering Tobacco Smoke

According to another embodiment of the present invention, there is provided a method of filtering tobacco in a smokable device. The method comprises the steps of, first, providing a smokable device comprising the tobacco smoke filter according to the present invention affixed to a body of divided tobacco. Next, the body of divided tobacco is ignited such that smoke passes through the body and into the filter. Then, the smoke is allowed to pass through the filter, thereby filtering the smoke.

Method of Making a Smokable Device

According to another embodiment of the present invention, there is provided a method of making a smokable device. The method comprises the steps of, first, providing a tobacco smoke filter according to the present invention. Next, the filter is affixed to a body of divided tobacco.

Although the present invention has been discussed in considerable detail with reference to certain preferred embodiments, other embodiments are possible. Therefore, the scope of the appended claims should not be limited to the description of preferred embodiments contained in this disclosure. All references cited herein are incorporated by reference to their entirety.

What is claimed is:

1. A tobacco smoke filter comprising one or more than one metal phthalocyanine, and further comprising one or more than one polycationic polymer;

where the phthalocyanine is selected from the group consisting of C.1. Reactive Blue 21 dye and ORCO Turquoise Blue GGX dye; and where the one or more than one polycationic polymer is selected from the group consisting of poly (propyleneimine), polyvinylamine, poly(2-ethylaziridine), poly(2,2-dimethylaziridine), and poly (2,2-dimethyl-3-n-propylaziridine) and a combination of the preceding.

2. The tobacco smoke filter according to claim 1, where the one or more than one polycationic polymer has a molecular weight greater than about 1000 Daltons.

3. The tobacco smoke filter according to claim 1, where the one or more than one polycationic polymer has a molecular weight of between about 1000 and 100,000 Daltons.

4. The tobacco smoke filter according to claim 1, further comprising cellulose that is substantially free of cellulose acetate.

5. The tobacco smoke filter according to claim 1, further comprising one or more than one pH-modifying filter additive other than the polycationic polymer.

6. The tobacco smoke filter according to claim 5, where the one or more than one pH-modifying filter additive is an inorganic salt.

7. The tobacco smoke filter according to claim 6, where the inorganic salt is selected from the group consisting of sodium carbonate, calcium carbonate, sodium phosphate, calcium phosphate and a cationic ion exchange resin.

8. The tobacco smoke filter according to claim 1, further comprising chitin.

9. The tobacco smoke filter according to claim 1, where the one or more than one metal phthalocyanine and the one or more than one polycationic polymer are dispersed throughout the filter in a substantially uniform manner.

10. The tobacco smoke filter according to claim 1, where the tobacco smoke filter comprises a first segment and a second segment, where the first segment comprises the one or more than one metal phthalocyanine and the one or more than one polycationic polymer, and where the second segment is substantially free of both a metal phthalocyanine and a polycationic polymer.

11. A smokable device comprising a tobacco smoke filter according to claim 1.

12. A method of filtering tobacco smoke comprising:

a) providing a smokable device according to claim 11;

b) igniting the body of divided tobacco such that smoke passes through the body and into the filter; and c) allowing the smoke to pass through the filter, thereby filtering the smoke.

13. A method of making a smokable device comprising:

a) providing a tobacco smoke filter according claim 1; and b) affixing the filter to a body of divided tobacco.

14. The method of making a smokable device according to claim 13, further comprising spraying a solution of the one or more than one polycationic polymer onto material being made into the tobacco smoke filter, where the concentration of polycationic polymer in the solution is between about 0.5 and 50%.

15. The method of making a smokable device according to claim 13, further comprising spraying a solution of the one or more than one polycationic polymer onto material being made into the tobacco smoke filter, where the concentration of polycationic polymer in the solution is between about 1 and 10%.

16. The method of making a smokable device according to claim 13, where the tobacco smoke filter comprises paper made from pulp, and where the method further comprises adding the polycationic polymer to the pulp before the pulp is laid onto papermaking screens.

17. A tabacco smoke filter comprising one or more than one iron phthalocyanine, and further comprising one or more than one polycationic polymer;

where the one or more than one polycationic polymer is selected from the group consisting of poly (propyleneimine), polyvinylamine, poly(2-ethylaziridine), poly(2,2-dimethylaziridine), and poly (2,2-dimethyl-3-n-propylaziridine) and a combination of the preceding.

18. The tobacco smoke filter according to claim 17, where the iron phthalocyanine is an iron analog of C.I. Reactive Blue 21 dye.

19. The tobacco smoke filter according to claim 17, where the one or more than one polycationic polymer has a molecular weight greater than about 1000 Daltons.

20. The tobacco smoke filter according to claim 17, where the one or more than one polycationic polymer has a molecular weight of between about 1000 and 100,000 Daltons.

21. The tobacco smoke filter according to claim 17, further comprising cellulose that is substantially free of cellulose acetate.

22. The tobacco smoke filter according to claim 17, further comprising one or more than one pH-modifying filter additive other than the polycationic polymer.

23. The tobacco smoke filter according to claim 22, where the one or more than one pH-modifying filter additive is an inorganic salt.

24. The tobacco smoke filter according to claim 23, where the inorganic salt is selected from the group consisting of sodium carbonate, calcium carbonate, sodium phosphate, calcium phosphate and a cationic ion exchange resin.

25. The tobacco smoke filter according to claim 17, further comprising chitin.

26. The tobacco smoke filter according to claim 17, where the one or more than one iron phthalocyanine and the one or more than one polycationic polymer are dispersed throughout the filter in a substantially uniform manner.

27. The tobacco smoke filter according to claim 17, where the tobacco smoke filter comprises a first segment and a second segment, where the first segment comprises the one or more than one iron phthalocyanine and the one or more than one polycationic polymer, and where the second segment is substantially free of both an iron phthalocyanine and a polycationic polymer.

28. A smokable device comprising a tobacco smoke filter according to claim 27.

29. A method of filtering tobacco smoke comprising:

a) providing a smokable device according to claim 28;

b) igniting the body of divided tobacco such that smoke passes through the body and into the filter; and c) allowing the smoke to pass through the filter, thereby filtering the smoke.

30. A method of making a smokable device comprising:

a) providing a tobacco smoke filter according claim 27; and b) affixing the filter to a body of divided tobacco.

31. The method of making a smokable a smokable device according to claim 30, further comprising spraying a solution of the one or more than one polycationic polymer onto material being made into the tobacco smoke filter, where the concentration of polycationic polymer in the solution is between about 0.5 and 50%.

32. The method of making a smokable device according to claim 30, further comprising spraying a solution of the one or more than one polycationic polymer onto material being made into the tobacco smoke filter, where the concentration of polycationic polymer in the solution is between about 1 and 10%.

33. The method of making a smokable device according to claim 30, where the tobacco smoke filter comprises paper made from pulp, and where the method further comprises adding the polycationic polymer to the pulp before the pulp is laid onto papermaking screens.

34. A tobacco smoke filter comprising one or more than one metal phthalocyanine, and further comprising one or more than one polycationic polymer selected from the group consisting of poly(propyleneimine), polyvinylamine, poly (2-ethylaziridine), poly(2,2-dimethylaziridine), and poly(2, 2-dimethyl-3-n-propylaziridine) and a combination of the preceding.

35. The tobacco smoke filter according to claim 34, where the one or more than one metal phthalocyanine is a copper phthalocyanine.

36. The tobacco smoke filter according to claim 34, where the one or more than one polymer has a molecular weight greater than about 1000 Daltons.

37. The tobacco smoke filter according to claim 34, where the one or more than one polycationic polymer has a molecular weight of between about 1000 and 100,000 Daltons.

38. The tobacco smoke filter according to claim 34, further comprising cellulose that is substantially free of cellulose acetate.

39. The tobacco smoke filter according to claim 34, further comprising one or more than one pH-modifying filter additive other than the polycationic polymer; and where the one or more than one pH-modifying filter additive is an inorganic salt.

40. The tobacco smoke filter according to claim 39, where the inorganic salt is selected from the group consisting of sodium carbonate, calcium carbonate, sodium phosphate, calcium phosphate and a cationic ion exchange resin.

41. The tobacco smoke filter according to claim 34, where the one or more than one metal phthalocyanine and the one or more than one polycationic polymer are dispersed throughout the filter in a substantially uniform manner.

42. A smokable device comprising a tobacco smoke filter according to claim 34.

43. A method of filtering tobacco smoke comprising:

a) providing a smokable device according to claim 42;

b) igniting the body of divided tobacco such that smoke passes through the body and into the filter; and c) allowing the smoke to pass through the filter, thereby filtering the smoke.

44. A method of making a smokable device comprising:

a) providing a tobacco smoke filter according claim 34; and b) affixing the filter to a body of divided tobacco.

45. The method of making a smokable device according to claim 44, further comprising spraying a solution of the one or more than one polycationic polymer onto material being made into the tobacco smoke filter, where the concentration of polycationic polymer in the solution is between about 0.5 and 50%.

46. The method of making a smokable device according to claim 44, further comprising spraying a solution of the one or more than one polycationic polymer onto material being made into the tobacco smoke filter, where the concentration of polycationic polymer in the solution is between about 1 and 10%.

47. A tobacco smoke filter comprising one or more than one metal phthalocyanine, one or more than one polycationic polymer and one or more than one pH-modifying filter additive other than the polycationic polymer;

where the one or more than one polycationic polymer is selected from the group consisting of poly (propyleneimine), polyvinylamine, poly(2-ethylaziridine), poly(2,2-dimethylaziridine), and poly (2,2-dimethyl-3-n-propylaziridine) and a combination of the preceding.

48. The tobacco smoke filter according to claim 47, where the one or more than one metal phthalocyanine is a copper phthalocyanine.

49. The tobacco smoke filter according to claim 48, where the copper phthalocyanine is selected from the group consisting of C.I. Reactive Blue 21 dye and ORCO Turquoise Blue GGX dye.

50. The tobacco smoke filter according to claim 47, where the one or more than one metal phthalocyanine is an iron phthalocyanine.

51. The tobacco smoke filter according to claim 50, where the iron phthalocyanine is an iron analog of C.I. Reactive Blue 21 dye.

52. The tobacco smoke filter according to claim 47, where the one or more than one polycationic polymer has a molecular weight greater than about 1000 Daltons.

53. The tobacco smoke filter according to claim 47, where the one or more than one polycationic polymer has a molecular weight of between about 1000 and 100,000 Daltons.

54. The tobacco smoke filter according to claim 47, further comprising cellulose that is substantially free of cellulose acetate.

55. The tobacco smoke filter according to claim 47, where the one or more than one metal phthalocyanine is a copper phthalocyanine, and where the polycationic polymer is polyethyleneimine.

56. The tobacco smoke filter according to claim 47, where the one or more than one metal phthalocyanine is an iron phthalocyanine, and where the polycationic polymer is polyethyleneimine.

57. The tobacco smoke filter according to claim 47, where the one or more than one pH-modifying filter additive other than the polycationic polymer is selected from the group consisting of sodium carbonate, calcium carbonate, sodium phosphate, calcium phosphate and a cationic ion exchange resin.

58. The tobacco smoke filter according to claim 47, further comprising chitin.

59. The tobacco smoke filter according to claim 47, where the one or more than one metal phthalocyanine and the one or more than one polycationic polymer are dispersed throughout the filter in a substantially uniform manner.

60. The tobacco smoke filter according to claim 47, wherein the tobacco smoke filter comprises a first segment and a second segment, where the first segment comprises the one or more than one metal phthalocyanine and the one or more than one polycationic polymer, and where the second segment is substantially free of both a metal phthalocyanine and a polycationic polymer.

61. A smokable device comprising a tobacco smoke filter according to claim 47.

62. A method of filtering tobacco smoke comprising:

a) providing a smokable device according to claim 61;

b) igniting the body of divided tobacco such that smoke passes through the body and into the filter; and c) allowing the smoke to pass through the filter, thereby filtering the smoke.

63. A method of making a smokable device comprising:

a) providing a tobacco smoke filter according claim 47; and b) affixing the filter to a body of divided tobacco.

64. The method of making a smokable device according to claim 63, further comprising spraying a solution of the one or more than one polycationic polymer onto material being made into the tobacco smoke filter, where the concentration of polycationic polymer in the solution is between about 0.5 and 50%.

65. The method of making a smokable device according to claim 63, further comprising spraying a solution of the one or more than one polycationic polymer onto material being made into the tobacco smoke filter, where the concentration of polycationic polymer in the solution is between about 1 and 10%.

66. The method of making a smokable device according to claim 63, where the tobacco smoke filter comprises paper made from pulp, and where the method further comprises adding the polycationic polymer to the pulp to the pulp before the pulp is laid onto papermaking screens.

67. A tobacco smoke filter comprising one or more than one metal phthalocyanine, one or more than one polycationic polymer, and chitin;

where the one or more than one polycationic polymer is selected from the group consisting of poly (propyleneimine), polyvvinylamine, poly(2-ethlaziridine), poly(2,2-dimethylaziridine), and poly(2, 2-dimethyl-3-n-propylaziridine) and a combination of the preceding.

68. The tobacco smoke filter according to claim 67, where the one or more than one metal phthalocyanine is a copper phthalocyanine.

69. The tobacco smoke filter according to claim 68, where the copper phthalocyanine is selected from the group consisting of C.I. Reactive Blue 21 dye and ORCO Turquoise Blue GGX dye.

70. The tobacco smoke filter according to claim 67, where the one or more than one metal phthalocyanine is an iron phthalocyanine is a iron phthalocyanine.

71. The tobacco smoke filter according to claim 70, where the iron phthalocyanine is an iron analog of C.I. Reactive Blue 21 dye.

72. The tobacco smoke filter according to claim 67, where the one or more than one polycationic polymer has a molecular weight greater than about 1000 Daltons.

73. The tobacco smoke filter according to claim 67, where the one or more than one polymer has a molecular weight of between about 1000 and 100,000 Daltons.

74. The tobacco smoke filter according to claim 67, further comprising cellulose that is substantially free of cellulose acetate.

75. The tobacco smoke filter according to claim 67, further comprising one or more than one pH-modifying filter additive other than the polycationic polymer.

76. The tobacco smoke filter according to claim 75, where the one or more than one pH-modifying filter additive is an inorganic salt.

77. The tobacco smoke filter according to claim 76, where the inorganic salt is selected from the group consisting of sodium carbonate, calcium carbonate, sodium phosphate, calcium phosphate and a cationic ion exchange resin.

78. The tobacco smoke filter according to claim 67, where the one or more than one metal phthalocyanine and the one or more than one polycationic polymer are dispersed throughout the filter in a substantially uniform manner.

79. The tobacco smoke filter according to claim 67, where the tobacco smoke filter comprises a first segment and a second segment, where the first segment comprises the one or more than one metal phthalocyanine and the one or more than one polycationic polymer, and where the second segment is substantially free of both a metal phthalocyanine and a polycationic polymer.

80. A smokable device comprising a tobacco smoke filter according to claim 67.

81. A method of filtering tobacco smoke comprising:

a) providing a smokable device according to claim 80;

b) igniting the body of divided tobacco such that smoke passes through the body and into the filter; and c) allowing the smoke to pass through the filter, thereby filtering the smoke.

82. A method of making a smokable device comprising:

a) providing a tobacco smoke filter according claim 67; and b) affixing the filter to a body of divided tobacco.

83. The method of making a smokable device according to claim 82, further comprising spraying a solution of the one or more than one polycationic polymer onto material being made into the tobacco smoke filter, where the concentration of polycationic polymer in the solution is between about 0.5 and 50%.

84. The method of making a smokable device according to claim 82, further comprising spraying a solution of the one or more than one polycationic polymer onto material being made into the tobacco smoke filter, where the concentration of polycationic polymer in the solution is between about 1 and 10%.

85. The method of making a smokable device according to claim 82, where the tobacco smoke filter comprises paper made from pulp, and where the method further comprises adding the polycationic polymer to the pulp before the pulp is laid onto papermaking screens.

86. A tobacco smoke filter comprising a first segment and a second segment;

where the first segment comprises one or more than one metal phthalocyanine and one or more than one polycationic polymer;

where the second segment is substantially free of both a metal phthalocyanine and a polycationic polymer;

where the one or more than one polycationic polymer is selected from the group consistant of poly (propyleneimine), polyvinylamine, poly(2-ethylaziridine), poly(2,2-dimethylaziridine), and poly (2,2dimethyl-3-n-propylaziridine) and a combination of the preceding.

87. The tobacco smoke filter according to claim 86, where the one or more than one metal phthalocyanine is a copper phthalocyanine.

88. The tobacco smoke filter according to claim 87, where the copper phthalocyanine is selected from the group consisting of C.I. Reactive Blue 21 dye and ORCO Turquoise Blue GGX dye.

89. The tobacco smoke filter according to claim 86, where the one or more than one metal phthalocyanine is an iron phthalocyanine.

90. The tobacco smoke filter according to claim 89, where the iron phthalocyanine is an iron analog of C.I. Reactive Blue 21 dye.

91. The tobacco smoke filter according to claim 86, where the one or more than one polycationic polymer has a molecular weight greater than about 1000 Daltons.

92. The tobacco smoke filter according to claim 86, where the one or more than one polycationic polymer has a molecular weight of between about 1000 and 100,000 Daltons.

93. The tobacco smoke filter according to claim 86, futher comprising cellulose that is substantially free of cellulose acetate.

94. The tobacco smoke filter according to claim 86, where the one or more than one metal phthalocyanine is a copper phthalocyanine, and where the polycationic polyethyleneimine.

95. The tobacco smoke filter according to claim 86, where the one or more than one metal phthalocyanine is an iron phthalocyanine, and where the polycationic polymer is polyethyleneimine.

96. The tobacco smoke filter according to claim 86, further comprising one or more than one pH-modifying filter additive other than the polymer.

97. The tobacco smoke filter according to claim 96, where the one or more than one pH-modifying filter additive is an inorganic salt.

98. The tobacco smoke filter according to claim 97, where the inorganic salt is selected from the group consisting of sodium carbonate, sodium phosphate, calcium phosphate and a cationic ion exchange resin.

99. The tobacco smoke filter according to claim 86, further comprising chitin.

100. The tobacco smoke filter according to claim 86, where the one or more than one metal phthalocyanine and the one or more than one polycationic polymer are dispersed throughout the filter in a substantially uniform manner.

101. A smokable device comprising a tobacco smoke filter according to claim 86.

102. A method of filtering tobacco smoke comprising:

a) providing a smokable device according to claim 101;

b) igniting the body of divided tobacco such that smoke passes through the body and into the filter; and c) allowing the smoke to pass through the filter, thereby filtering the smoke.

103. A method of making a smokable device comprising:

a) providing a tobacco smoke filter according claim 86; and b) affixing the filter to a body of divided tobacco.

104. The method of making a smokable device according to claim 103, further comprising spraying a solution of the one or more than one polycationic polymer onto material being made into the tobacco smoke filter, where the concentration of polycationic polymer in the solution is between about 0.5 and 50%.

105. The method of making a smokable device according to claim 103, further comprising spraying a solution of the one or more than one polycationic polymer onto material being made into the tobacco smoke filter, where the concentration of polycationic polymer in the solution is between about 1 and 10%.

106. The method of making a smokable device according to claim 103, where the tobacco smoke filter comprises paper made from pulp, and where the method further comprises adding the polycationic polymer to the pulp before the pulp is laid onto papermaking screens.

107. A method of making a smokable device comprising:

a) providing a tobacco smoke filter comprising one or more than one metal phthalocyanine, and further comprising one or more than one polycationic polymer; and b) affixing the filter to a body of divided tobacco;

where the tobacco smoke filter comprises paper made from pulp, and where the method further comprises adding the polymer to the pulp before the pulp is laid onto papermaking screens.

108. The method of making a smokable device according to claim 107, further comprising spraying a solution of the one or more than one polycationic polymer onto material being made into the tobacco smoke filter, where the concentration of polycationic polymer in the solution is between about 0.5 and 50%.

109. The method of making a smokable device according to claim 107, further comprising spraying a solution of the one or more than one polycationic polymer onto material being made into the tobacco smoke filter, where the concentration of polycationic polymer in the solution is between about 1 and 10%.

110. The method of making a smokable device according to claim 107, where the tobacco smoke filter provided further comprises a first segment, a second segment and a third segment;

where the first segment comprises the one or more than one metal phthalocyanine but is substantially free of polycationic polymer;

where the second segment comprises both the one or more than one metal phthalocyanine and the one or more than one polymer; and where the third segment comprises the one or more than one polycationic polymer but is substantially free of a metal phthalocyanine.

111. The method of making a smokable device according to claim 110, where the first segment is between the second segment and the third segment.

112. The method of making a smokable device according to claim 110, where the second segment is between the first segment and the third segment.

113. The method of making a smokable device according to claim 110, where the third segment is between the first segment and the second segment.

114. The method of making a smokable device according to claim 107, where the one or more than one metal phthalocyanine is a copper phthalocyanine.

115. The method of making a smokable device according to claim 107, the one or more than one metal phthalocyanine is selected from the group consisting of C.I. Reactive Blue 21 dye and ORCO Turquoise Blue GGX dye.

116. The method of making a smokable device according to claim 107, where the one or more than one metal phthalocyanine is an iron phthalocyanine.

117. The method of making a smokable device according to claim 116, where the iron phthalocyanine is an iron analog of C.I. Reactive Blue 21 dye.

118. The method of making a smokable device according to claim 107, where the one or more than one polycationic polymer has a cationic moiety comprising one or more than one primary or secondary amino group.

119. The method of making a smokable device according to claim 107, where the one or more than one polycationic polymer is selected from the group consisting of poly (propyleneimine), poly vinylamine, poly(2-ethylaziridine), poly(2,2-dimethylaziridine), and poly(2,2-dimethyl-3-n-propylaziridine) and a combination of the preceding.

120. The method of making a smokable device according to claim 107, where the one or more than one polycationic polymerr is polyethyleneimine.

121. The method of making a smokable device according to claim 107, where the one or more than one polycationic polymer has a molecular weight greater than about 1000 Daltons.

122. The method of making a smokable device according to claim 107, where the one or more than one polycationic polymer has a molecular weight of between about 1000 and 100,000 Daltons.

123. The method of making a smokable device according to claim 107, where the tobacco smoke filter provided further comprises cellulose that is substantially free of cellulose acetate.

124. The method of making a smokable device according to claim 107, where the tobacco smoke filter provided further comprises one or more than one pH-modifying filter additive other than the polycationic polymer.

125. The method of making a smokable device according to claim 124, where the one or more than one pH-modifying filter additive is an inorganic salt.

126. The method of making a smokable device according to claim 125, where the inorganic salt is selected from the group consisting of sodium carbonate, calcium carbonate, sodium phosphate, calcium phosphate and a cationic ion exchange resin.

127. The method of making a smokable device according to claim 107, where the tobacco smoke filter provided further comprises chitin.

128. A tobacco smoke filter comprising one or more than one metal phthalocyanine, and further comprising one or more than one polycationic polymer;

where the tobacco smoke filter comprises a first segment, a second segment and a third segment;

where the second segment comprises both the one or more than one metal phthalocyanine but is substantially free of polycationic polymer;

where the third segment comprises both the one or more than one metal phthaloccyan and the one or more than one polycationic polymer; and where the third segment comprises the one or more than one polycationic polymer but is substantially free of a metal phthalocyanine.

129. The tobacco smoke filter according to claim 128, where the first segment is between the second segment and the third segment.

130. The tobacco smoke filter according to claim 128, where the second segment is between the first segment and the third segment.

131. The tobacco smoke filter according to claim 128, where the third segment is between the first segment and the second segment.

132. The tobacco smoke filter according to claim 128, where the one or more than one metal phthalocyanine is a copper phthalocyanine.

133. The tobacco smoke filter of claim 128, where the one or more than one metal phtalocyanine is selected from the group consisting of C.I. Reactive Blue 21 dye and ORCO Turquoise Blue GGX dye.

134. The tobacco smoke filter according to claim 128, where the one or more than one metal phthalocyanine is an iron phthalocyanine.

135. The tobacco smoke filter according to claim 128, where the iron phthalocyanine is an iron analog of C.I. Reactive Blue 21 dye.

136. The tobacco smoke filter of claim 128, where the one or more than one polycatoinic polymer has a cationic moiety comprising one or more than one primary or secondary amino group.

137. The tobacco smoke filter of claim 128, where the one or more than one polycationic polymer is selected from the group consisting of poly(propyleneimine), polyvinylamine, poly(2-ethylaziridine), poly(2,2-dimethylaziridine), and poly(2,2-dimethylaziridine), and a combination of the preceding.

138. The tobacco smoke filter according to claim 128, where the one or more than one polycationic polymer is polyethyleneimine.

139. The tobacco smoke filter according to claim 128, where the one or more than one polycationic polymer has a molecular weight greater than about 1000 Daltons.

140. The tobacco smoke filter according to claim 128, where the one or more than one polycationic polymer has a molecular weight of between about 1000 and 100,000 Daltons.

141. The tobacco smoke filter according to claim 128, further comprising cellulose that is substantially free of cellulose acetate.

142. The tobacco smoke filter according to claim 128 further comprising one or more than one pH-modifying filter additive other than the polycationic polymer.

143. The tobacco smoke filter according to claim 142, where the one or more than one pH-modifying filter additive is an inorganic salt.

144. The tobacco smoke filter according to claim 143, where the inorganic salt is selected from the group consisting of sodium carbonate, calcium carbonate, sodium phosphate calcium phosphate and a cationic ion exchange resin.

145. The tobacco smoke filter according to claim 128, further comprising chitlin.

* * * * *

UNITED STATES PATENT AND TRADEMARK OFFICE

CERTIFICATE OF CORRECTION

PATENT NO. : 7,104,265 B2
APPLICATION NO. : 10/803409
DATED : September 12, 2006
INVENTOR(S) : Reid von Borstel It is certified that error appears in the above-identified patent and that said Letters Patent is hereby corrected as shown below:

Claim 1, column 19, line 67: replace “C.1. Reactive Blue 21” with --C.I. Reactive Blue 21--.

Claim 17, column 21, line 1: replace “tabacco” with --tobacco--.

Claim 28, column 21, line 47: replace “claim 27” with --claim 17--.

Claim 30, column 21, line 55: replace “claim 27” with --claim 17--.

Claim 31, column 21, line 58: delete second occurrence of “a smokable”.

Claim 36, column 22, line 20: replace “one polymer” with --one polycationic polymer--.

Claim 66, column 24, line 20: delete second occurrence of “to the pulp”.

Claim 67, column 24, lines 27: replace “polyvvinylamine” with --polyvinylamine--.

Claim 67, column 24, lines 27-28: replace “poly(2-ethlaziridine)” with --poly (2-ethylaziridine)--.

Claim 70, column 24, line 40: delete “is a iron phthalocyanine”.

Claim 73, column 24, line 48: replace “one polymer” with --one polycationic polymer--.

Claim 86, column 25, line 43: replace “consistant” with --consisting--.

Claim 86, column 25, line 46: replace “poly(2,2dimethyl-3-n-polypropylaziridine)” with --poly (2,2-dimethyl-3-n-polypropylaziridine)--.

Claim 93, column 26, line 1: replace “futher” with --further--.

Claim 94, column 26, lines 6-7: replace “polycationic polyethyleneimine” with --polycationic polymer is polyethyleneimine--.

Claim 96, column 26, line 14: replace “the polymer” with --the polycationic polymer--.

Claim 98, column 26, line 20: after “sodium carbonate,” insert --calcium carbonate,--.

Claim 107: column 26, line 64: replace “the polymer” with --the polycationic polymer--.

UNITED STATES PATENT AND TRADEMARK OFFICE

CERTIFICATE OF CORRECTION

PATENT NO. : 7,104,265 B2
APPLICATION NO. : 10/803409
DATED : September 12, 2006
INVENTOR(S) : Reid von Borstel It is certified that error appears in the above-identified patent and that said Letters Patent is hereby corrected as shown below:

Claim 110: column 27, line 20: replace “the polymer” with --the polycationic polymer--.

Claim 119: column 27, line 53: replace “poly vinylamine” with --polyvinylamine--.

Claim 120: column 27, line 58: replace “polymerr” with --polymer--.

Claim 128: column 28, line 23: replace “second” with --first-- and delete “both”; line 26: replace “third” with --second--; line 27: replace “phthaloccyan” with --phthalocyanine--.

Claim 133: column 28, line 44: replace “phtalocyanine” with --phthalocyanine--.

Claim 136: column 28, line 54: replace “polycatoinic” with --polycationic--.

Claim 137: column 28, line 61: replace “poly(2,2-dimethylaziridine),” with --poly (2,2-dimethyl-3-n-propylaziridine)--.

Claim 144: column 30, lines 6-7: insert --,-- after “sodium phosphate”.

Claim 145: column 30, line 9: replace “chitlin” with --chitin--.

Signed and Sealed this

Second Day of October, 2007

JON W. DUDAS
*Director of the United States Patent and Trademark Office*